United States Patent [19]

Daigle

[11] 4,418,252

[45] Nov. 29, 1983

[54] KEY SWITCH ASSEMBLY

[76] Inventor: Phillip R. Daigle, 4298 Wilson Ave., Rolling Meadows, Ill. 60008

[21] Appl. No.: 365,565

[22] Filed: Apr. 5, 1982

[51] Int. Cl.[3] ..... H01H 15/00

[52] U.S. Cl. ..... 200/16 A; 200/159 R; 200/291; 200/276; 200/340

[58] Field of Search ..... 200/16 R, 16 A, 16 B, 200/16 C, 16 D, 16 E, 16 F, 159 R, 291, 276, 302, 340, 252, 243, 77

[56] References Cited

U.S. PATENT DOCUMENTS

| | | | |
|---|---|---|---|
| 1,868,482 | 7/1932 | Austin | 200/162 |
| 1,873,141 | 8/1932 | Norviel et al. | 200/159 R |
| 3,699,296 | 10/1972 | Harris | 200/67 DB |
| 3,732,387 | 5/1973 | Berry | 200/159 R |
| 3,735,058 | 5/1973 | Berry | 200/16 A |
| 3,767,878 | 10/1973 | Sykora | 200/276 X |
| 3,823,292 | 7/1974 | Murata | 200/159 R |
| 3,858,021 | 12/1974 | Brandlein | 200/164 |
| 3,863,040 | 1/1975 | Benschoten et al. | 200/67 DB |
| 4,020,444 | 4/1977 | Oelsch et al. | 338/202 |
| 4,034,177 | 7/1977 | Sims, Jr. | 200/159 R |
| 4,132,877 | 1/1979 | Daigle | 200/159 X |
| 4,354,069 | 10/1982 | Ragen | 200/291 X |

*Primary Examiner*—Elliot A. Goldberg
*Assistant Examiner*—Morris Ginsburg
*Attorney, Agent, or Firm*—McCaleb, Lucas & Brugman

[57] ABSTRACT

A single or multiple pole key switch having a molded plastic housing formed with snap-in devices for mounting connection with a support and having a key stem reciprocatingly movable through one wall of the housing and having multiple guide surfaces thereon cooperating with corresponding surfaces of said housing for minimizing rotation, wobble and binding of the key stem in operation. The lower end of the key stem engages a return spring and is provided with at least one lateral cavity for carrying at least one contact spring for cooperation with stationary contacts mounted on a terminal block mounted in opposing adjacency thereto. A detent bar is provided on the terminal block to radially deflect the contact spring during key stem operation which provides the operator with "feel" of the switch action and produces an adjustable hysteresis or differential between the make and break of the contacts to avoid unwanted contact opening or closure and afford dampened make and break contact action. Contact reliability is promoted by unique wiping action of portions of the contact spring over the stationary contacts.

6 Claims, 9 Drawing Figures

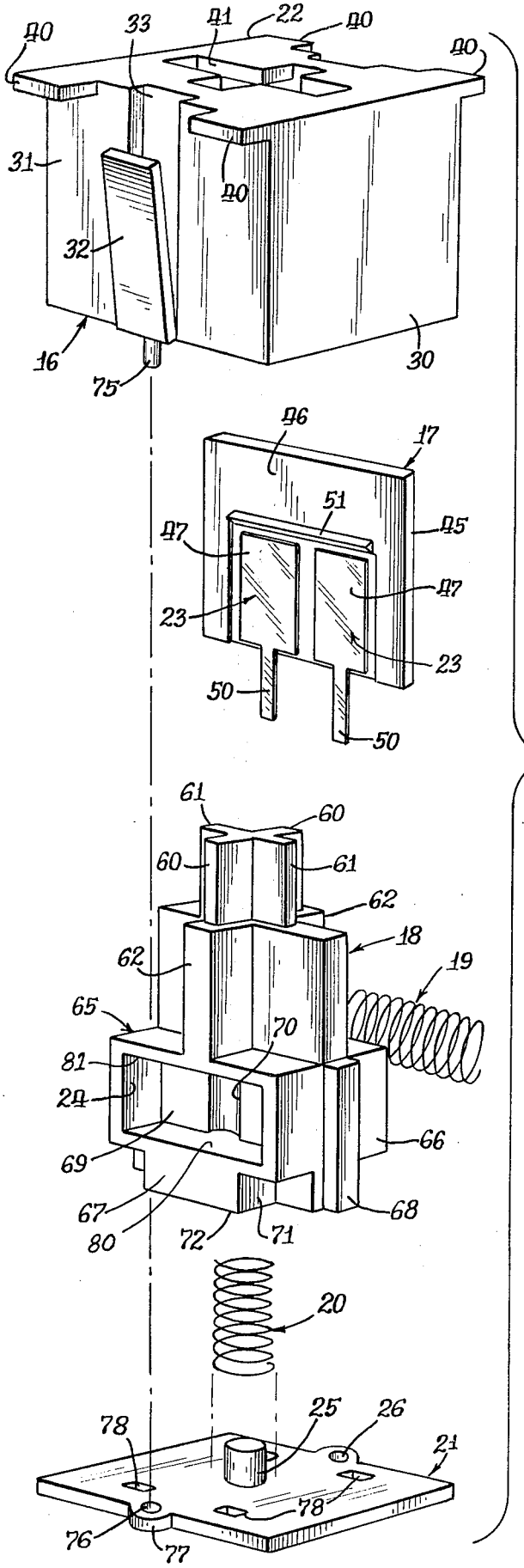
Fig. 3.
Fig. 1.
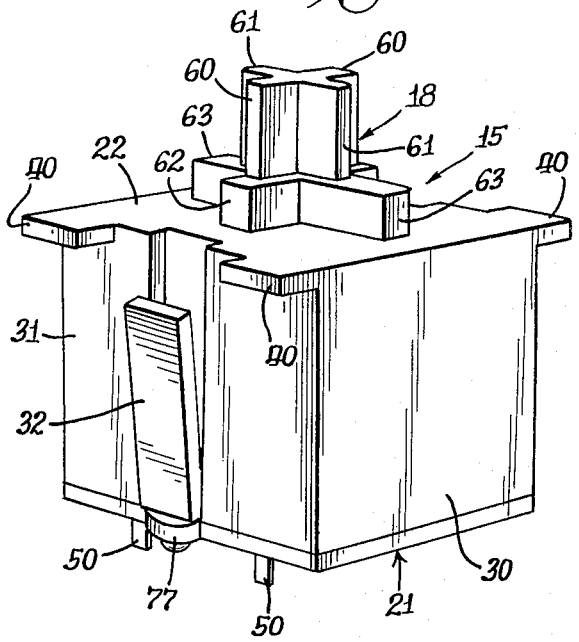
Fig. 2.
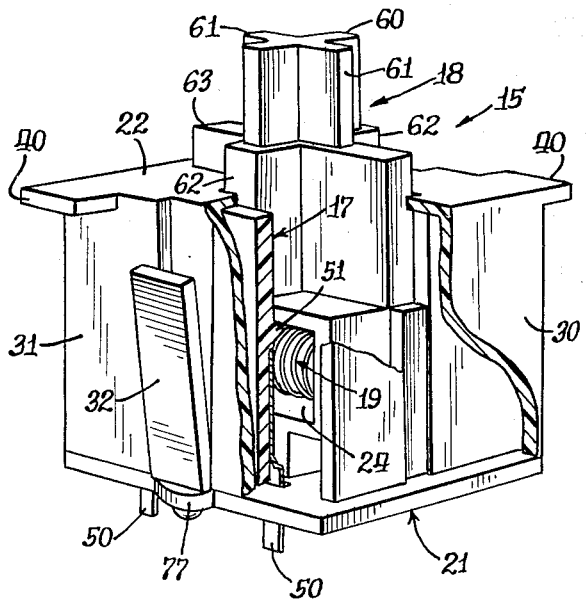

KEY SWITCH ASSEMBLY

This invention relates to push button or key switch assemblies and more particularly to improved structural combinations of elements for a push button switch of the type wherein a conductive coil spring functions as a moving contact.

Push button switches of the general order to which this invention pertains are widely used for input switching operations in computers, typewriter keyboards and similar control operations because of their fast switching capabilites. However, past switches of this general character have been characterized by wobbling, cocking and sticking of the key stem during its reciprocating operating stroke, particularly if the initiating force on the key stem is not imposed substantially axially thereof. In addition, many such prior known switches have been characterized by a lack of "feel" for the switching operation, making it difficult for the operator to sense switch position. In still other instances, operational dependability has been lacking due to the susceptibility of the switch contacts to become dirty or fouled during repeated operations accompanied by unwarranted contact wear due to the lack of any dampening action during the make and break of circuits therethrough.

Typifying some of the earlier developments in push button or key stem switches of the order above referred to, are the structure set out in U.S. Pat. Nos. 3,493,705; 3,699,296; 3,732,387; 3,735,058; 3,823,292; 3,858,021; 3,863,040 and 4,034,177.

SUMMARY OF THE INVENTION

The present invention is directed to an improved push button or key operated switch particularly useful in the control of electronic circuits as in computers, electrical typewriters, and similar control environments. In brief, this invention is directed to improved combinations of elements embodying a two part plastic resin housing of unified molded construction which is mounted about a reciprocably movable key stem. A plurality of large area guide surfaces on the key stem are arranged to cooperate with suitably configured surfaces of the housing whereby to effectively and positively guide the key stem in its normal vertical translation to prevent wobble, rotation and interference to its smooth and rapid movement; manually engageable key or button means being affixed to the upper end of the key stem exteriorly of the housing for engagement by the operator. Interiorly of the housing the key stem carries at least one coil spring contact within a cavity formed in one lateral side of the key stem for effecting contact with spaced contact members carried on an adjacent terminal block. A removable bottom wall serves to enclose the hollow interior of the housing and the operating elements of the key switch for simplified assembly. The switch of this invention is further characterized by a unique hysteresis or time delay function between the make and break of the contacts which is brought about by virtue of a detenct provided internally of the housing for interfering engagement with and radial deformation of the spring contact during reciprocating activity of the key stem. This feature also provides the operator with a "feel" for the operating position of the key stem which is vertically depressed against a single return spring means located within the housing enclosure. Because of a novel formation of the contact spring carrying cavity associated with the key stem, the coil contact spring, in addition to its hysteresis deformation above referred to, also has portions thereof which move transversely of the path of movement for the key stem, causing a desirable wiping or scrubbing activity to take place for maintaining the contacts free of corrosion, assuring positive circuit making engagement thereof.

It is a principal object of this invention to provide an improved key switch embodying coil spring contact means and means for effecting an adjustable hysteresis or time delay between the make and break of switch contacts.

Another important object of this invention is to provide an improved key stem switch of the order referred to in the preceding object which has improved means for guiding the key stem thereof in operation to avoid binding, wobble, rotation and like unwanted movements.

Another object of this invention is to provide an improved key switch for use in controlling electronic circuitry which incorporates means affording an operational feel for the switch position and means for modifying the operating force for the key stem.

Still another object of this invention is to provide an improved key switch having a simplified structural arrangement of parts which adapts the same for single and multiple pole operation.

A still further important object of this invention is to provide an improved key switch utilizing coil spring contact means movable in response to activity of a key stem or plunger and which is carried in a manner to promote wiping activity of stationary terminal contacts.

Another object of this invention is to provide an improved key switch which is of simplified structure, and exhibits economies of production, ease of assembly and dependability of operation.

Having thus described this invention, the above and further objects, features and advantages thereof will appear to those familiar with the art from the following detailed description of a preferred embodiment thereof, illustrated in the accompanying drawings and representing the best mode presently contemplated for enabling others to practice this invention.

IN THE DRAWINGS

FIG. 1 is a perspective showing of a switch assembly of this invention;

FIG. 2 is another perspective showing of the switch illustrated in FIG. 1 with portions thereof broken away in sections to demonstrate the interior assembly of parts therein;

FIG. 3 is an exploded perspective view of the switch assembly illustrated in FIGS. 1 and 2 and demonstrating the arrangements of parts thereof;

DESCRIPTION OF THE PREFERRED EMBODIMENT

Figure 6:
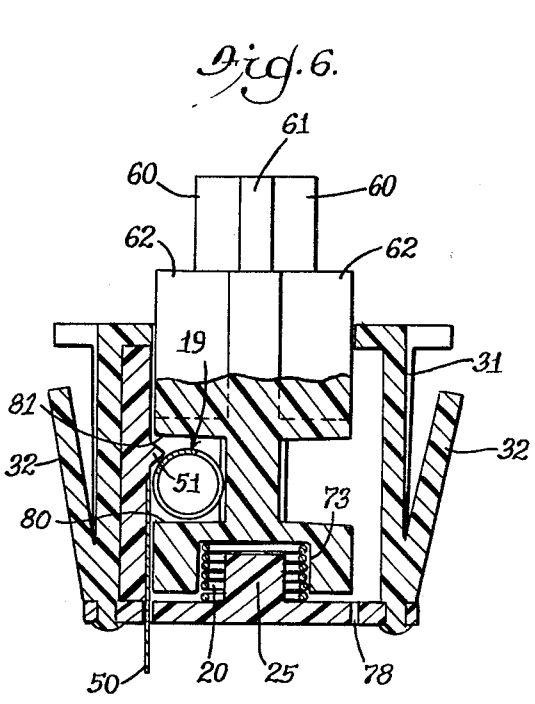
FIGS. 4, 5 and 6 are elevational views with portions broken away in section to demonstrate the positioning of parts during the contact make cycle.

Turning now to the specifics of the preferred embodiment of this invention and the multiple pole modification thereof illustrated in the accompanying drawings, initial reference is made to FIGS. 1 through 3.

As shown in those figures, the key switch assembly 15, according to this invention, comprises a housing 16, one or more terminal block assemblies 17 mountable within the housing 16, a key stem 18 movable in the housing and carrying one or more contact springs 19, and a return spring 20 carried between the lower end of the key stem and a bottom wall 21 of the housing.

Figure 9:
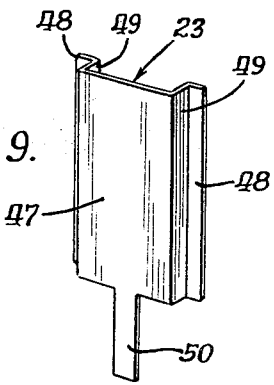
FIG. 9 is a perspective view of a contact element used with a terminal block of the order illustrated in FIG. 3 of the drawings.

It will be recognized from FIG. 2 in particular that the housing 16 is shown as a rectangular parallelopiped having a hollow interior receptive of the key stem 18 for movement through the housing's upper wall 22. Interiorly of the housing and along at least one side of the key stem is the substantially planar terminal block assembly 17 carrying a pair of spaced contact plate elements 23, 23 (see FIGS. 3 and 9). Located in a socket 24 formed inwardly of the lateral side of the key stem opposite the terminal block assembly 17, is a coil contact spring means 19 adapted to engage and make contact with the spaced contact plates 23, 23 for circuit making operation. Disposed coaxially beneath the lower end of the key stem 18 is a compression coil return spring 20 adapted to be centered on an upstanding boss portion 25 on the lower cover member 21 to provide opposition to the depression of the key stem 18.

The housing 16, as best shown in FIGS. 1 through 6 of the drawings, is formed preferably by a die cast molding of a suitable plastic resin material so as to effectuate a unitary molded member having a substantially rectangular plan profile enclosing a generally rectangular shaped hollow interior, over covered by the top wall 22 and open along its bottom side for the assembly of parts therein and enclosure by the bottom wall member 21.

It will be understood that the rectangular shaped housing is defined by a pair of parallel spaced, planar end walls 30, 30 and a pair of parallel spaced sidewalls 31, 31 (see FIGS. 7 and 8) extending between the end walls 30, 30. Each wall 31 is distinguished by a generally trapezoidal shaped, centrally disposed and operationally vertically extending cantilever finger 32 molded with the sidewalls 31, 31 of the housing and having integral connection therewith at its lower end. Each of the cantilever fingers 32 is disposed opposite a correspondingly shaped recess 33 inset in the adjacent sidewall 31, with the locking fingers 32 normally extending angularly outwardly of the general plane of the sidewalls 31, 31 (see FIGS. 4 through 6). These locking fingers 32, 32 constitute snap-in locking devices on opposite side of the housing for interlocking the same with a mounting panel through which the housing is inserted at installation (see FIG. 4).

As best shown in FIG. 3 of the drawings, the top wall 22 of the housing 16 extends transversely across and between the several walls 30, 31 of the housing body and includes rectangular shaped ear portions 40, 40 projecting from the four corners of the top wall and outwardly of the sidewalls 31, 31. These ear portions cooperate with the locking devices 32 for interlocking the housing with a mounting panel; the ear portions 40, 40 being disposed on top of the panel and the flexible locking means 32 underengaging the panel adjacent an opening formed in the panel for reception of the housing 16. In this manner, quick acting interlock means is provided on the housing for securing the same to a mounting panel.

In addition to the ears, 40, 40 as above noted, the housing's top panel or wall 22 is distinguished by a centrally disposed multi-sided or non-circular opening, herein shown as a cross shaped opening 41, the arms of which lie coincident with the lengthwise and widthwise axes of the housing 16. In this regard it is important to recognize that the opening 41 is disposed centrally of the top wall 22 and coaxially of the vertical axis of the housing, with the extending arm portions of the opening 41 aligned at right angles to each other to present a multiplicity of boundary surfaces for purposes to be explained presently.

With reference to FIGS. 2 and 3 of the drawings, it also will be regarded that the terminal block assembly 17 comprises a rectangular shaped block member 45 of electrically insulating or non-conductive material. Normally the terminal block 45 is molded of plastic resin material and includes cored out areas or channels spaced in at least one face 46 thereof for the mounting reception of a pair of spaced contact plate members 23, 23 of the order illustrated best in FIG. 9. As shown in the latter figure, each contact member 23 is formed of thin metal, such as beryllium copper or phosphor bronze to comprise a generally channel or U-shaped configuration in cross section providing a planar central body portion 47 flanked by a pair of longitudinally extending flanges 48, 48, paralleling body portion 47 and offset from the plane of the body portion by intervening right angularly related lengs 49, 49. The lower end of the body portion 47 is distinguished by a depending terminal pin or strip 50 and the entire exterior of the contact member or an appropriate band or strip thereof may be gold plated to provide a good electrical conductive contact area.

Figure 8:
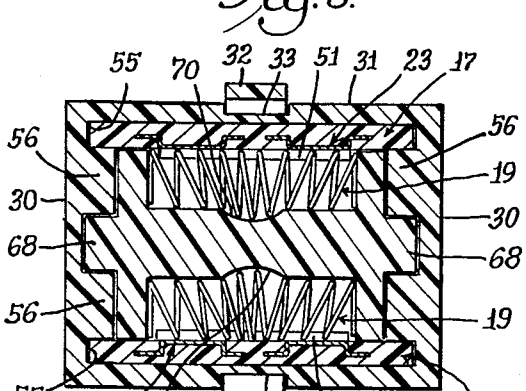
FIG. 8 is another cross-sectional view, similar to FIG. 7, and illustrating a modification of the FIG. 7 structure to provide a multiple pole switch.
Figure 7:
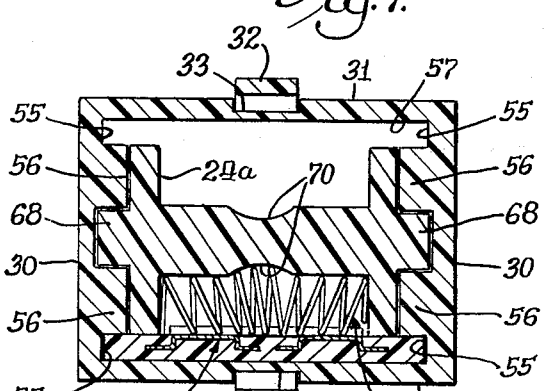
FIG. 7 is a cross-sectional view taken substantially along vantage line 7—7 of FIG. 4 and looking in the direction of the arrows thereon.

As will best be understood by examining FIGS. 7 and 8, the cored out areas in the block member 45 provide for sliding reception of the flange portions 48 and intervening leg portions 49 of two contact plate members 23 such that a pair of contact members are mounted in laterally spaced relation on the one face 46 of the block member.

Figure 5:
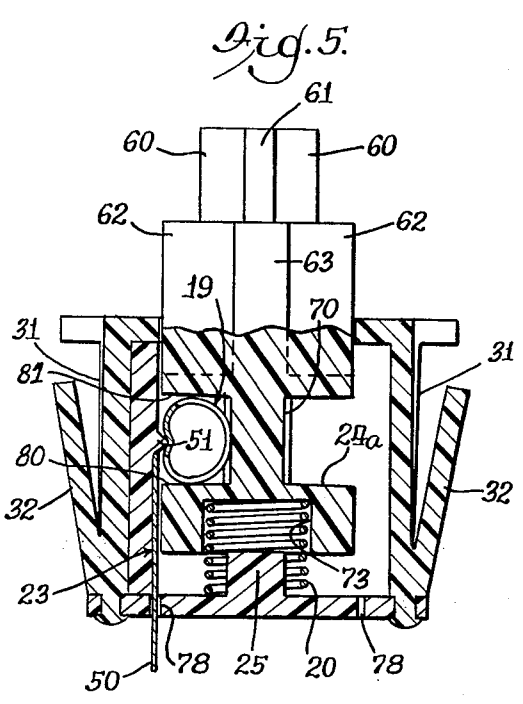
Figure 4:
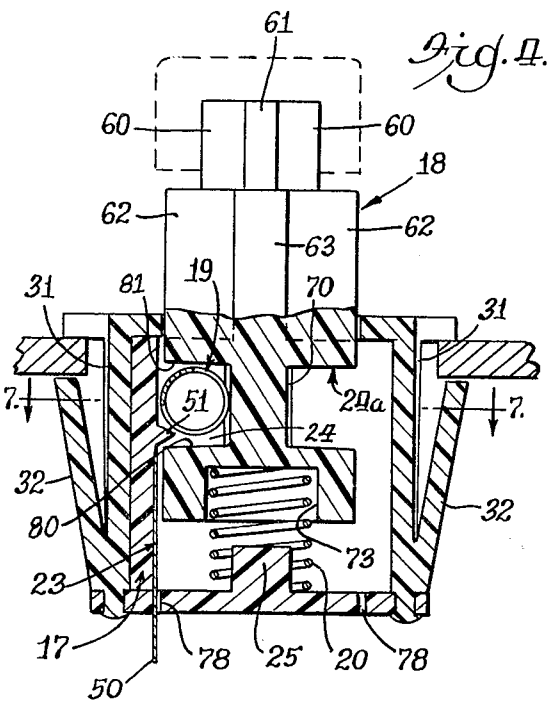

Immediately above the contact plates is a transversely extending detent bar 51, shown in the particular embodiment as being substantially triangular in cross-section (see FIGS. 4 and 5). This bar cooperates with the contact spring means 19 as will be described hereinafter. In general the terminal block 17 is inserted into the interior of the housing 16 via the open bottom thereof to lie parallel to sidewalls 31, 31 and more specifically is held in channel spaces 55, 55 formed by opposed pairs of spaced rectangulary shaped guide rails 56, 56 projecting inwardly of the inside faces of the housing's end walls 30, 30 (see FIGS. 7 and 8). With particular regard to these guide rails 56, it will be noted that the same are spaced from the inside faces of the sidewalls 31, 31 distances appropriate to accept the thickness of a terminal block 45 so that insertion of the terminal blocks in the grooves or channels 55 produces a relatively snug friction fit between the terminal block and the inside face 57 of an adjacent sidewall 31, as shown best in FIG. 7. When appropriately mounted within the interior of the housing 16, the terminal end portions 50 of the contact plate members 23 extend or project in depending fashion below the bottom end of the housing 16 for passage through the bottom wall or cover member 21, as will be described hereinafter. It will be noted also that the body portions 47 of each of the contact plates face inwardly of the housing's interior for engagement by the contact spring means 19 in operation.

With reference to FIG. 8, it will be seen that while the illustrated embodiment sent out in FIGS. 1 through 3 of the drawings, for example, includes only a single terminal block member 17 and a single pair of the contact plates 23, 23, the design of the interior housing 16 is such as to permit the mounting of a pair of terminal blocks therein, opposite each other on the interior sidewall faces 57. With this arrangement a multiple pole switch utilizing a pair of contact springs 19 mounted in sockets 24 and 24*a* on opposite sides of the stem member is provided.

Turning now to the structure of the stem member 18, the principle features thereof are best shown in FIG. 3. As shown, stem member 18 preferably comprises a unitary member suitably molded of plastic resin having a generally multi-faceted or sided transverse cross section (herein shown at cruciform) to comprise an upper outer end portion. In the illustrated case, four right angular related arm portions 60, 60 and 61 are arranged to intersect at the longitudinal axis of member 18; forming a cross shaped projection at the outer upper end of the stem member for interfitting engagement with an operating button mounted over its outer end as shown in phantom in FIG. 4.

Disposed immediately below the cross shaped end portion of the member 18 is an intermediate cross shaped portion comprising four right angularly related arm portions 62, 62 and 63, 63, aligned to intersect coaxially of the major or vertical axis of the member 18. It will be noted that the arm portions of this intermediate section are aligned with, but are somewhat thicker than the arm portions 60 and 61 at the upper end portion of member 18. Portions 62, 63 are specifically designed to fit closely within the confines of the cross shaped opening 41 formed through the top wall of the housing as shown in FIGS. 1 and 2. With this arrangement the right angularly related arm portions 62 and 63 provide maximum surface areas to afford good bearing engagement with the periphery of opening 41 whereby to effectively guide the stem member in its vertical reciprocating movements through the upper wall of the housing 16. It is to be recognized that the multi-sided formations of the intermediate stem portion and opening 41, are such as to prevent rotation of the stem member during its passage in and along opening 41. For this purpose, opening 41 and the matching cross section of the stem member may comprise any shape other than circular, such as an oval or polygonal. Because of this arrangement rotational movement of the stem member is substantially prevented or diminished to a degree where it is not longer objectionable.

Formed immediately below the bottom ends of the intersecting wall portion 62, 63 and integral therewith is a generally rectangular shaped main body portion 65 for the stem member 18, having end walls 66 and planar sidewalls 67 related at right angles to one another. The end walls 66 are distinguished by vertically extending, outwardly projecting and centrally located rectangularly rail portions 68 aligned with arm portions 63, 63 of the intermediate cross shaped portion or section; such rail portions 68 extending outwardly of the planes of the end walls 66. Formed inwardly of the sidewalls 67 of the body portion 65 are two transverse spring receptive sockets 24 and 24*a*, previously noted, which are generally rectangular in shape. The bottom wall 69 of each of these sockets is further distinguished by a centrally disposed semi-cylindrical depression 70 which is of particular significance in the operation of the contact spring means 19 as will be detailed presently. For purposes of saving material and weight, the four bottom corners of the rectangular main body section 65 may be recessed or cut away as indicated at 71.

The bottom end wall 72 of body portion 65 is also distinguished by a centrally located and coaxially extending cylindrical socket 73, as best illustrated in FIGS. 4 through 6 of the drawings. This socket receives the upper end of the return spring means 20 is assembly. It will be recalled that the other or lower end of the return spring means 20 fits over the raised boss 25 formed on the inside face of the bottom cover member 21 when the latter member is mounted with the housing 16.

Turning now to the two linear guide rails 68, 68 formed on opposite sides of the stem member 18, it will be appreciated from FIG. 7 that such rails are adapted to fit between the spaced rail portions 56, 56 formed to project from the opposing interior of the housing's end walls 30, 30. When so arranged, the rail members 68 slidingly move in and along the channels provided by the spacing between the interior rail portions 56, 56 and thus serve to guide the stem member in and throughout its vertical reciprocating movements relative to the housing 16. This guide system further steadies the stem member and prevents any unwanted wobble, canting or tilting thereof to avoid binding during its switch operating movements.

As previously noted at least one contact spring means 19, comprising an electrically conductive spring metal coil, preferably made of beryllium copper, with a good conductive planting, such as gold or silver, is compressably inserted into at least one of the laterally disposed sockets 24 or 24*a* in the manner illustrated in FIGS. 4 through 6. In the event that a multiple pole switch structure is to be provided, then two such contact springs are assembled in the housing with the stem member, one in each socket 24, 24*a* in the manner indicated in FIGS. 8 of the drawings.

Referring to FIGS. 7 and 8, it is to be noted that when contact spring 19 is mounted in its recess chamber 24 as shown, the central coils thereof are disposed opposite the semi-cylindrical recess 70. Thus when the stem member and its contact spring or springs are inserted in the housing to engage the contacts 23, 23 on the opposing terminal blocks 17, the central coils of spring 19 lie generally normal to the plane of the contact plates 23, 23 and substantially without deformation, due to the distance between the bottom of the recess 70 and the plane of the contact plates 23 being substantially equal to or greater than the outside diameter of the spring means 19. On the other hand, the end coils of the spring, beyond the central portion thereof, are deformed and squeezed radially, causing the same to assume a canted or sloping position relative to the lengthwise axis of spring 19. Thus the end coils of the spring are, as illustrated, squeezed outwrdly at an angle across the end portions of chamber 24 and thereby held in close engagement with the contact plates 23 and or the terminal block 17, depending on the position of the switch. Uniquely during the vertical movements of the plunger or stem member 18, the angular disposition of the end portions of spring 19 cause such coils to work or flex laterally in the socket chamber 24 to effectuate a positive wiping or scrubbing action across the face of the contact plates 23. This maintains relatively corrosion and dirt free surfaces on the contact plates and the engaging coils of the spring means 19. It also will be noticed, for instance, that the central coils of the spring means 19, disposed opposite and within the recess 70, do not in fact enter into the switch make or break contact operations, which are carried out via the canted end coils of the contact spring.

Once the terminal block 17, the stem 18 and the contact spring 19 are mounted within the hollow interior of housing 16, assembly of the return spring 20 and the bottom cover member 21 is carried out; the spring 20 fitting into the central cylindrical socket 73 at the btoom end of the key stem member 18 and over the upwardly extending boss 25 on the bottom cover wall 21. For purposes of mounting the cover wall in position to enclose the hollow interior of the housing 16, the lower end of each of cantilever spring latch members 32, 32 is formed with a cylindrical extension 75 adapted to pass through an appropriate opening 76 formed centrally of an ear portion 77 formed on the cover plate (see FIG. 3). In addition, each of the openings 76 is flanked by a pair of generally rectangular shaped openings 78, 78 appropriately spaced for the reception of the lower terminal end portions 50 of the adjacent contact plates 23, as best illustrated in FIGS. 4 through 6 of the drawings. With the extensions 75 through the openings 76, and the terminals 50 through opening 78, the cover 21 is locked in its assembled position by melting over the outer ends of the extensions 75, to permanently lock the cover in place. The extending terminal portions 50 of each of the contact plates are of course coupled to appropriate circuit boards or electrical networks in which the switching function to be performed by the assembly 15 is to occur.

USE AND OPERATION

Having described the various elemental portions which go to make up the improved switch assembly of this invention, its operating characteristics now will be described in association with a typical depressing cycle, for the stem 18 as illustrated in FIGS. 4 through 6 of the drawings.

As shown in FIG. 4, the key stem 18 is in its raised position, biased upwardly by the return springs means 20, with the contact spring 19 located above the detent bar 51 ready for a switch closing operation upon depression of stem 18. As the member 18 is pushed downwardly in response to manual engagement by the operator, the contact spring 19 is gradually rolled onto and over the detent bar 51, which is disposed generally parallel to the longitudinal axis of spring 19 in the manner indicated in FIG. 5. This action produces radial compression of the spring means 19 and serves to deform coils thereof so that the vertical spacing of the chamber 24 is substantially filled by the now deformed and oval shaped coils of the spring 19. It will be noted that during the transition of the spring 19 across the detent bar 51, all coils thereof are positively held out of engagement with the contact plates 23 and that in forcing the spring 19 over the hump of bar 51, the operator is aware, by feel, that switch action is taking place. Once the spring 19 passes the detent bar 51, as shown in FIG. 6, its coils (particularly the canted end coils) return to their cylindrical condition and snap into engagement with the face of the contact plates 23, 23 to close circuit therebetween. This provides a positive "make" of the circuit between the contact plates 23 and the bridging contact spring 19. As the key stem 18 is further depressed it continues downwardly until the lower end thereof engages the inside face of the bottom cover wall 21 with the extending boss 25 thereon engaging the bottom of the cylindrical cup or socket 73, providing a plastic to plastic bottoming stop action to the stem member. As long as the stem is held in its depressed state, circuit is maintained between the separated contact plates 23, 23. When the depressing force on stem 18 is removed by releasing the stem member 18 a reversal of the "make" action takes place.

It will be appreciated that as the stem 18 is depressed beyond the circuit "make" condition of FIG. 6, the contact spring 19 rolls over the detent bar and remains immediately below the same while the chamber 24 and stem member 18 continue to move downwardly relative to the spring member 19 until bottomed. As a consequence, prior to an upstroke of the stem member 18 there is a gap or space between the lower wall 80 of the chamber 24 and the overlying coils of contact spring 19. This gap provides a time lag or delay between the start of the upstroke for the stem member and the movement of the spring member upwardly therewith as effected by its engagement with the underdisposed wall 80 of the chamber 24. This accounts for the "hysteresis" effect previously referred to and, as will be readily understood and recognized, such time delay is readily adjustable depending on the vertical spacing between the walls 80 and 81 of the chamber 24 in relation to the diameter of the spring means 19. Thus if greater time delay is desirable then walls 80, 81 are spaced further apart and conversely if a shorter time or no time delay is desirable then the walls 80, 81 are appropriately spaced closer together, limited by the diameter of the contact spring 19.

In any event, it will be understood that until the wall 80 picks up or engages the contact spring 19 and reverses its deforming movement across the detent bar 51, contacting engagement between the two spaced contact plates 23, 23 is maintained by spring 19. Once the spring 19 starts over the hump of the detent bar 51, reversal of the condition illustrated in FIG. 5 occurs, that is contact is broken abruptly between the contact spring and the plates 23, as spring 19 is radially deformed and withdrawn from plates 23. This again gives the operator a "feel" of the switch operation. Once past the detent 51, the contact spring and stem member return to their normal, at rest position, as shown in FIG. 4 of the drawings.

One of the main advantages of the switch assembly 15 in accordance with this invention, lies in the fact that the "make" and "break" of contact between the spring 19 and the plates 23, 23 is positive and clean; as effected by the movement of the contact spring over the detent bar 51 and away from the contact plates. A further advantage is found in the ability to regulate the "feel" of the switch or, that is, the force required to effect "make" and "break" of the contacts. This is done by varying the size or projection of the detent bar 51 as well as the strength of return spring 20. In addition, the time delay or hysteresis feature is capable of adjustment by changing the spacing between the generally horizontal, although slightly divergent walls 80, 81 of the spring carrying chamber 24. Thus these desirable features and objectives are brought about.

From the foregoing it is believed those familiar with the art will readily understand and recognize the novel advancement of the present invention over previous developments in this art and will understand that while the same has been described hereinabove in association with a preferred embodiment illustrated in the accompanying drawings, the same is nevertheless susceptible to modification, variation and substitution of equivalents without departing from the spirit and scope of this invention as defined in the following appended claims.

The embodiments of the invention in which an exclusive property or privilege is claimed are defined as follows:

1. A key switch assembly comprising: a housing having a hollow interior and a top wall with a central multi-sided opening therethrough; a key stem member mountable within said housing and having a lengthwise stem portion formed with a transverse cross section conforming to said multi-sided opening to provide non-rotational guided movement of said stem portion therethrough; additional linear guide means within said housing comprising interfitting means on said key stem member and interior walls of said housing for restricting movement of said key stem member to a rectilinear path; a pair of co-planar, laterally spaced contact means mounted within said housing in opposing adjacency to one lateral side of said key stem member; coil contact spring means carried within a socket recess formed inwardly of said one lateral side of said key stem member; said socket recess being formed with parallel end walls, substantially parallel elongated side walls, extending between said end walls, and a planar bottom wall extending between said end and side walls and having a central recessed area of substantially semi-cylindrical formation; said coil contact spring means abutting said end walls and having central coils thereof extending into and confined by said recessed area whereby to angularly cant coil portions thereof lying axially between said central coils and said end walls; the spacing between said side kwalls permitting said coil contact spring means to rotate or roll in said socket recess in response to movement thereof with said key stem member as the latter moves linearly past said contact means thereby to cause the canted coil portions thereof to engage said contact means and clean the same with a scrubbing action.

2. The invention of claim 1, and detent means comprising an elongated projection paralleling the lengthwise axis of said socket recess and coil contact spring means and located between said one lateral side of said key stem member and an opposing interior wall of said housing; said detent means serving to interferingly engage said coil contact spring means and radially deform the same in response to movement of the latter thereover; such radial deformation of the coil contact spring means radially disengaging the same from said contact means in response to movement of said key stem member in one direction and effecting snap action engagement of said coil contact spring means with said contact means in response to movement of said key stem member in an opposite direction.

3. The invention of claim 1, wherein said side walls of said socket recess parallel the longitudinal axis of said coil contact spring means and are spaced apart a distance greater than the diameter of said coil contact spring means, one of said side walls engaging said coil contact spring means in response to movement of said key stem member in one direction and the other of said side walls engaging said coil contact spring means in response to movement of said key stem member in an opposite direction whereby to effect time delayed following movement of said coil contact spring means with said key stem member; said time delayed following movement being regulatable by selected spacing of said side walls.

4. The invention of claim 2, and terminal block means mounted in said housing and carrying said spaced contact means thereon in opposing relation to said one lateral side of said key stem member; said terminal block means having said detent means formed integrally therewith adjacent one end of said spaced contact means thereon.

5. The invention of claim 1, and a second pair of spaced contact means mounted within said housing, and second coil contact spring means carried in a second socket recess formed in said key stem member for opposingly contacting said second pair of spaced contact means to provide a multiple pole switch.

6. The invention of claim 1, wherein said opening through said one wall is cruciform and said key stem member has a corresponding transverse cross-sectional configuration whereby to prevent rotational movement of said key stem member.

* * * * *

UNITED STATES PATENT AND TRADEMARK OFFICE

CERTIFICATE OF CORRECTION

PATENT NO. : 4,418,252

DATED : November 29, 1983

INVENTOR(S) : Phillip R. Daigle

It is certified that error appears in the above-identified patent and that said Letters Patent is hereby corrected as shown below:

Column 3, Line 56 - "side" should read --sides--.

Column 4, Line 33 - "lengs" should read --legs--.

Column 6, Line 63 - "outwrdly" should read --outwardly--.

Column 7, Line 17 - "btoom" should read --bottom--.

Column 9, Line 42 - "Kwalls" should read --walls--.

Signed and Sealed this

*Twelfth* Day of *June 1984*

[SEAL]

*Attest:*

GERALD J. MOSSINGHOFF

*Attesting Officer*

*Commissioner of Patents and Trademarks*